US008197301B2

(12) United States Patent
Bae

(10) Patent No.: US 8,197,301 B2
(45) Date of Patent: Jun. 12, 2012

(54) CHEMICAL MECHANICAL POLISHING APPARATUS

(75) Inventor: Seung-Hun Bae, Seoul (KR)

(73) Assignees: Hae-Jun Bae, Seoul (KR); Hye-Yoon Bae, Seoul (KR)

( * ) Notice: Subject to any disclaimer, the term of this patent is extended or adjusted under 35 U.S.C. 154(b) by 0 days.

(21) Appl. No.: 13/239,039

(22) Filed: Sep. 21, 2011

(65) Prior Publication Data

US 2012/0021670 A1 Jan. 26, 2012

Related U.S. Application Data

(62) Division of application No. 11/920,381, filed as application No. PCT/KR2006/003098 on Aug. 7, 2006, now Pat. No. 8,038,509.

(30) Foreign Application Priority Data

Aug. 5, 2005 (KR) ..... 10-2005-0071543

(51) Int. Cl.
*B24B 49/00* (2012.01)

(52) U.S. Cl. ..... 451/8; 451/285

(58) Field of Classification Search ..... 451/5, 8, 451/11, 285–290
See application file for complete search history.

(56) References Cited

U.S. PATENT DOCUMENTS 5,720,845 A * 2/1998 Liu ..... 156/345.13
6,143,123 A * 11/2000 Robinson et al. ..... 451/289
6,935,929 B2 * 8/2005 Elledge ..... 451/41
7,008,309 B2 * 3/2006 Strasbaugh ..... 451/285
7,131,891 B2 * 11/2006 Elledge ..... 451/11
8,038,509 B2 * 10/2011 Bae ..... 451/8
2002/0019194 A1 * 2/2002 Moore ..... 451/5
2002/0028629 A1 * 3/2002 Moore ..... 451/6
2002/0037681 A1 * 3/2002 Gitis et al. ..... 451/5
2002/0081945 A1 * 6/2002 Kistler et al. ..... 451/9
2004/0033761 A1 * 2/2004 Ono et al. ..... 451/8
2004/0077292 A1 * 4/2004 Kim et al. ..... 451/5
2006/0052036 A1 * 3/2006 Kim et al. ..... 451/5

* cited by examiner

*Primary Examiner* — Maurina Rachuba
(74) *Attorney, Agent, or Firm* — Drinker Biddle & Reath LLP

(57) ABSTRACT

Disclosed herein is a chemical mechanical polishing apparatus. The apparatus comprises a carrier to hold a wafer and being capable of lifting, lowering and rotating, a polishing pad compressed onto the wafer through the lowering of the carrier to polish the wafer, a contact pressure sensor to detect contact pressure between the polishing pad and the wafer when the polishing pad is compressed onto the wafer, a support physical property controller to generate control signals corresponding to the contact pressure detected by the contact pressure sensor, a variable physical property support being adapted to come into close contact with the polishing pad and having physical properties varied in response to the control signals generated by the support physical property controller, and a rotational table to hold the variable physical property table.

25 Claims, 8 Drawing Sheets

[Fig. 1]
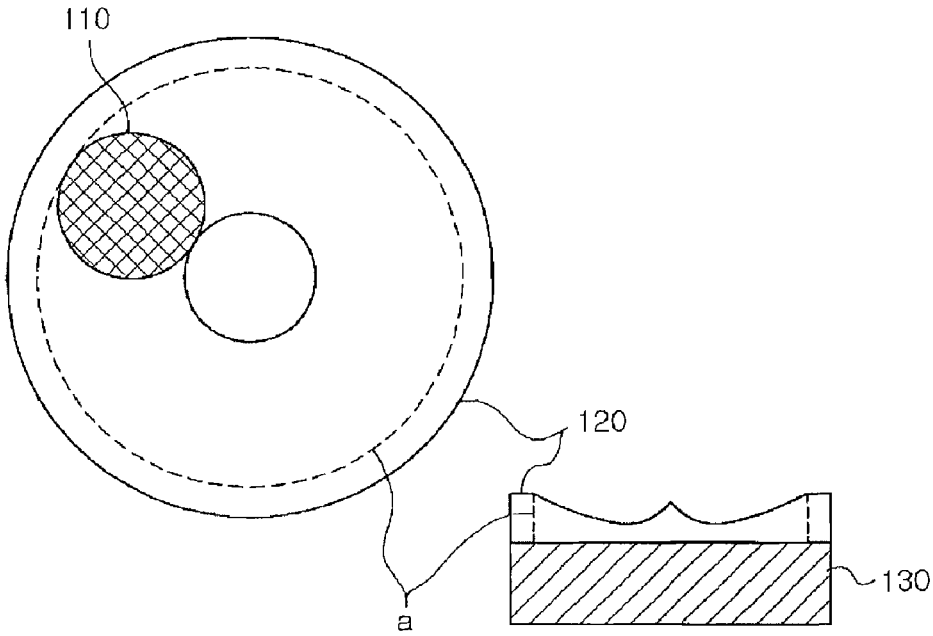
[Fig. 2]
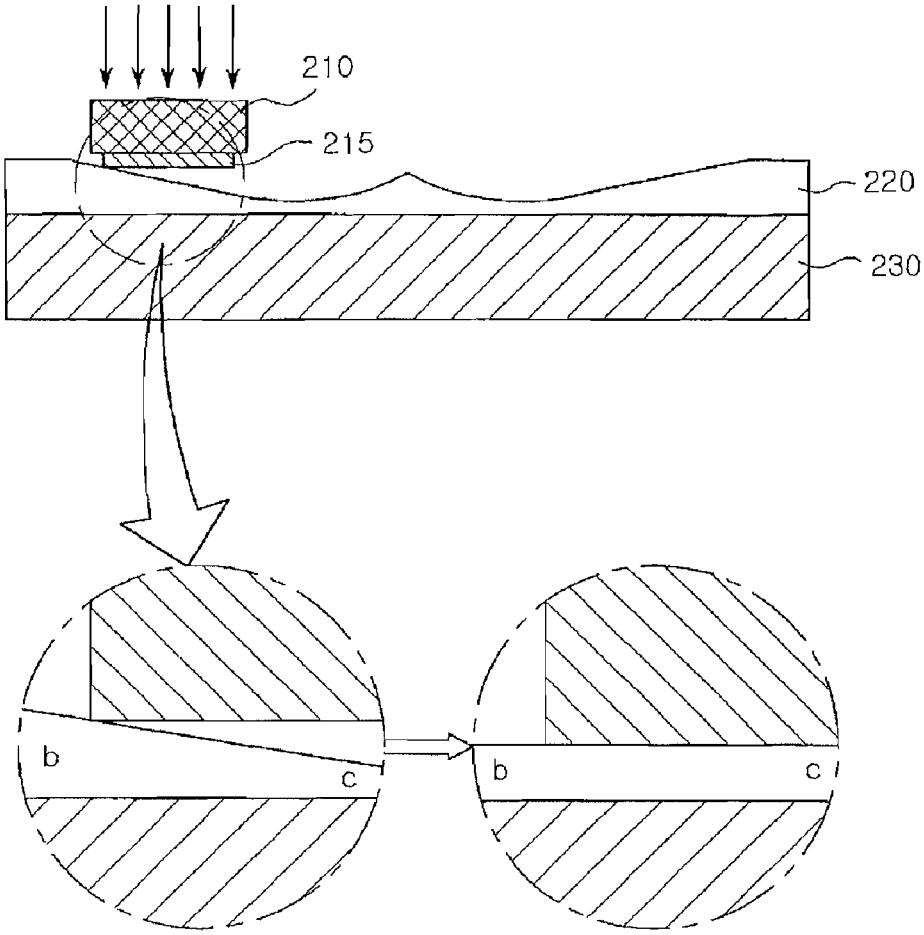

[Fig. 3]
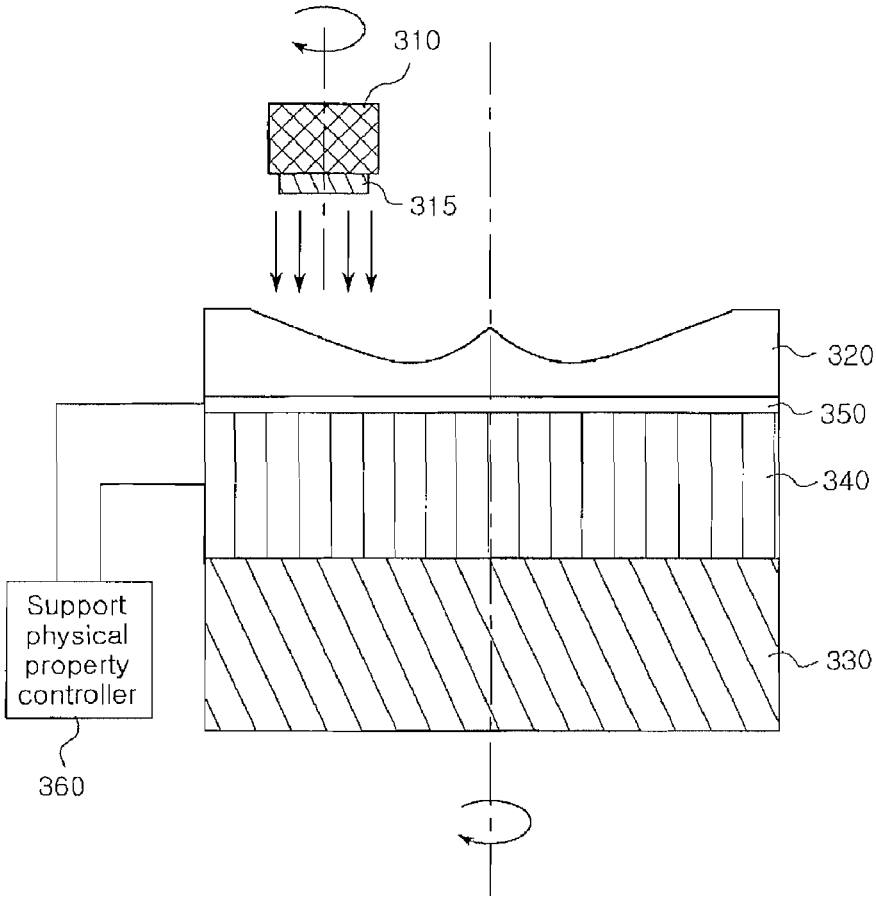
[Fig. 4]
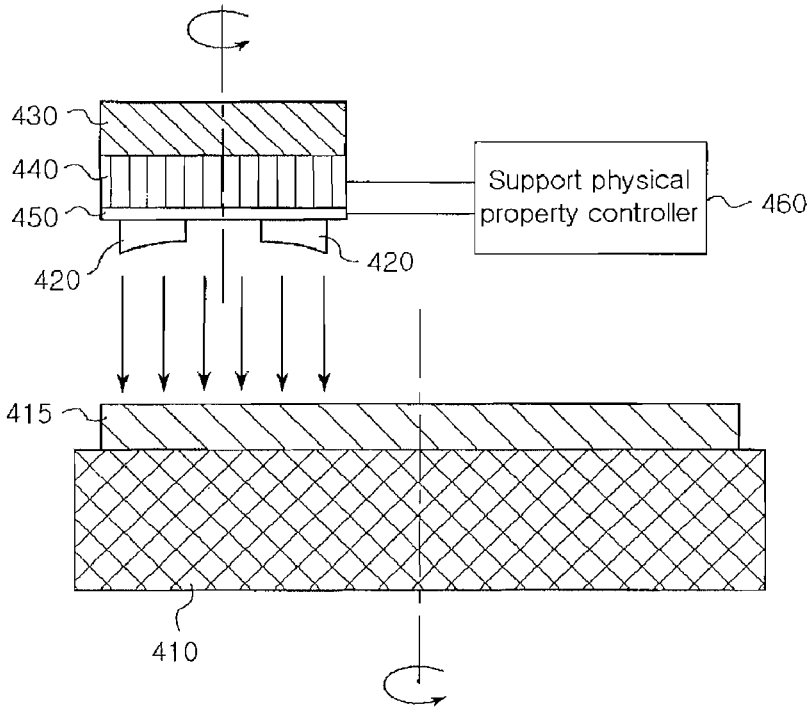

[Fig. 5]
(a)
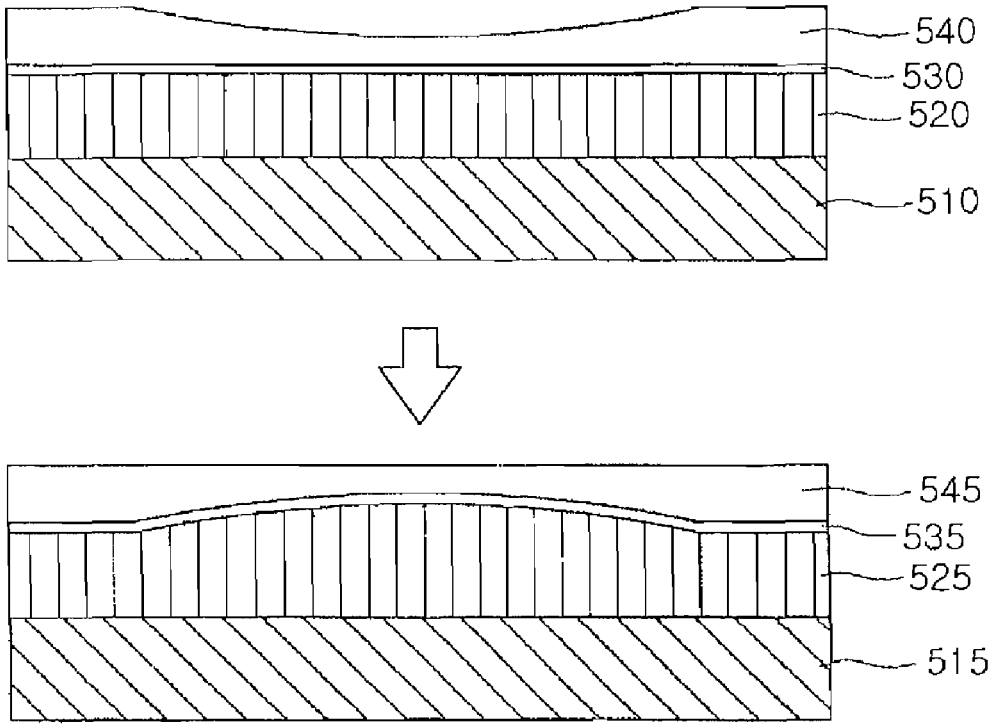
(b)
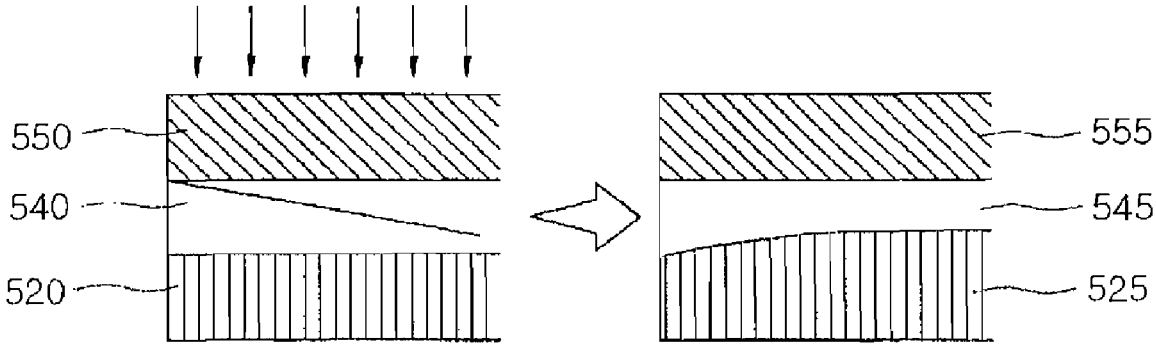

[Fig. 6]
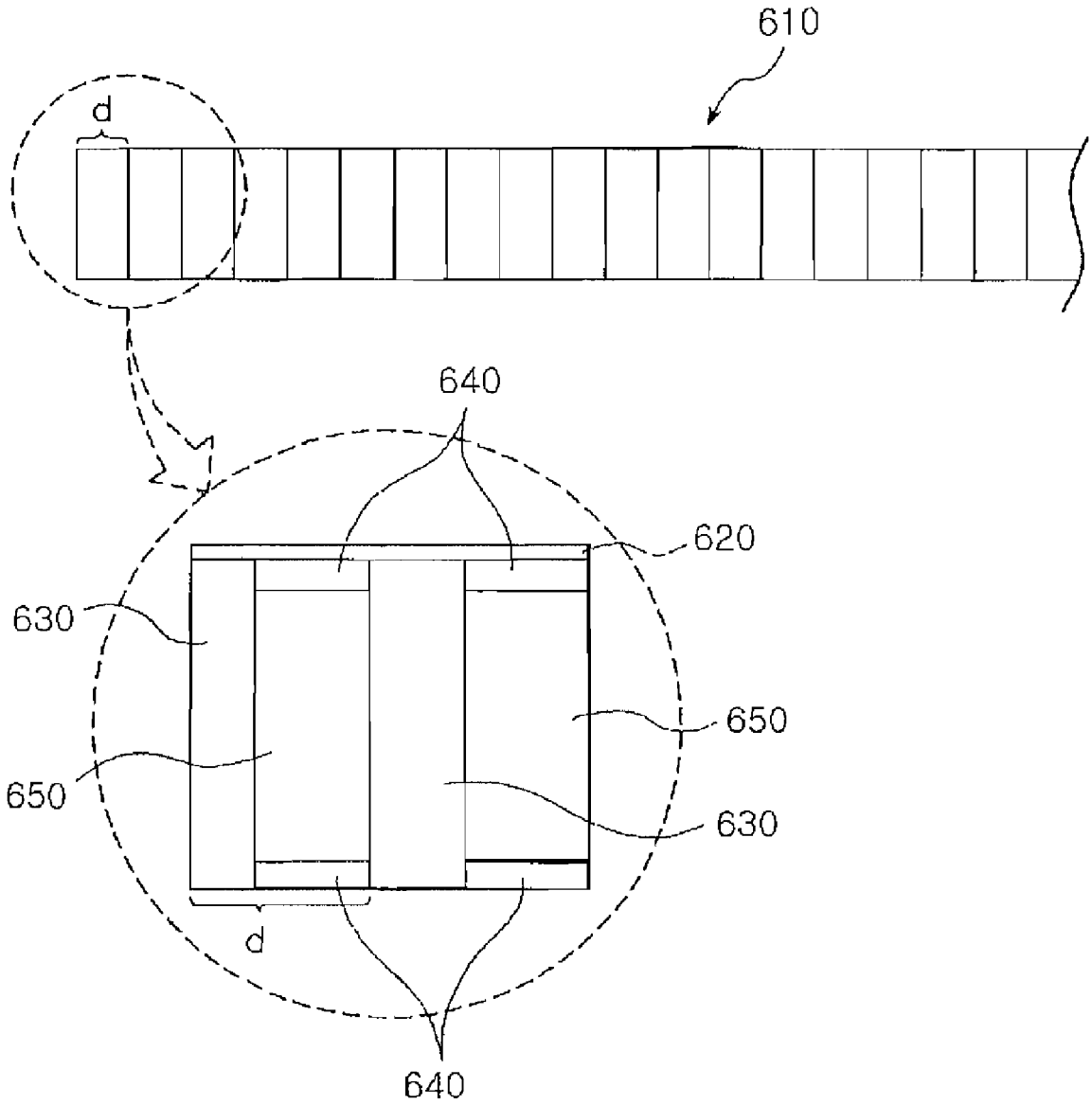

[Fig. 7]
(a)
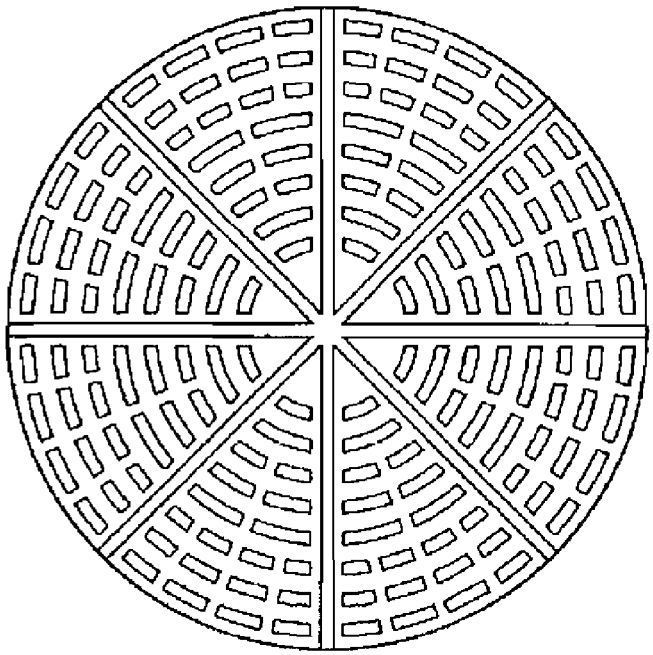
(b)
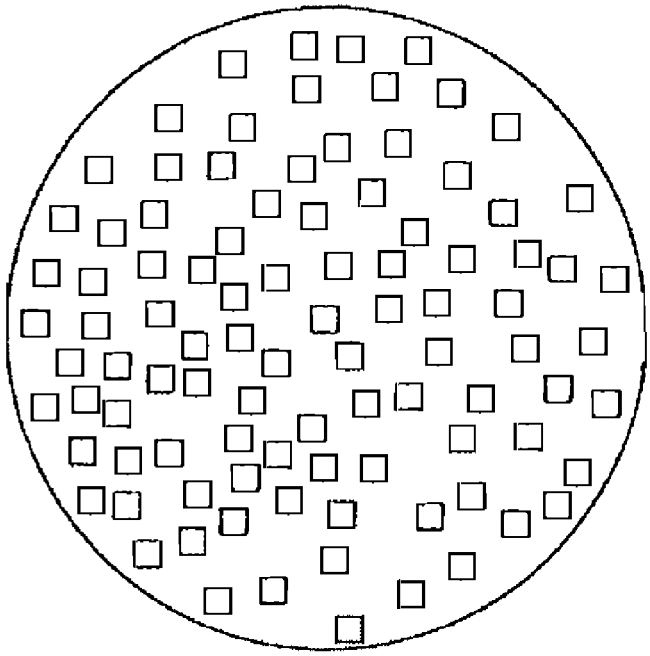

[Fig. 8]
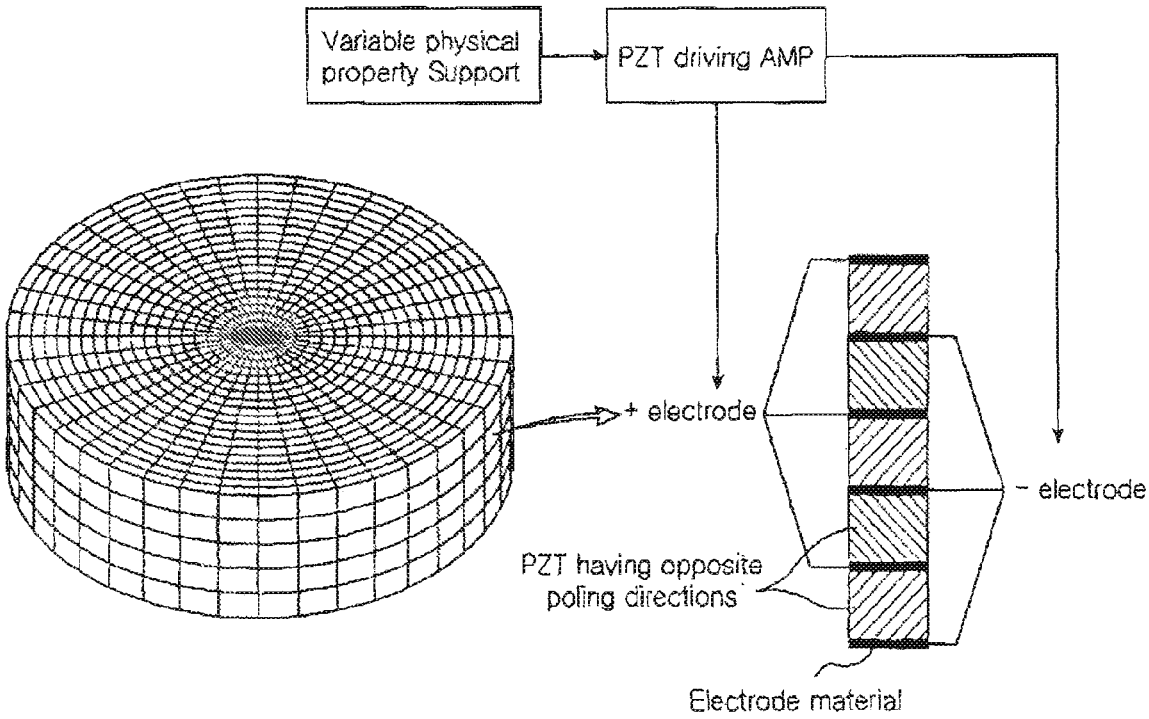
[Fig. 9]
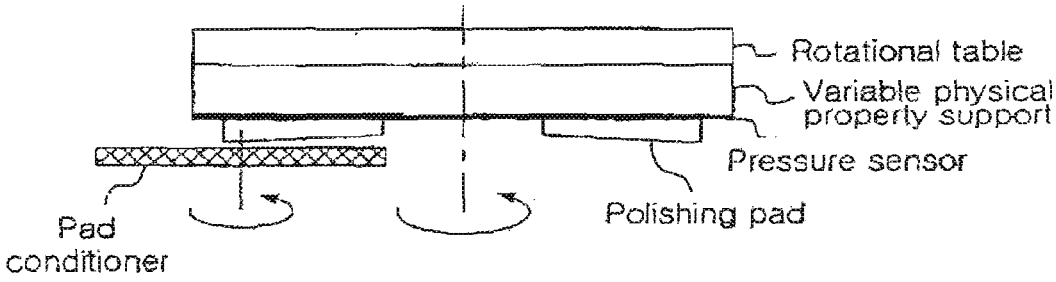

[Fig. 10]
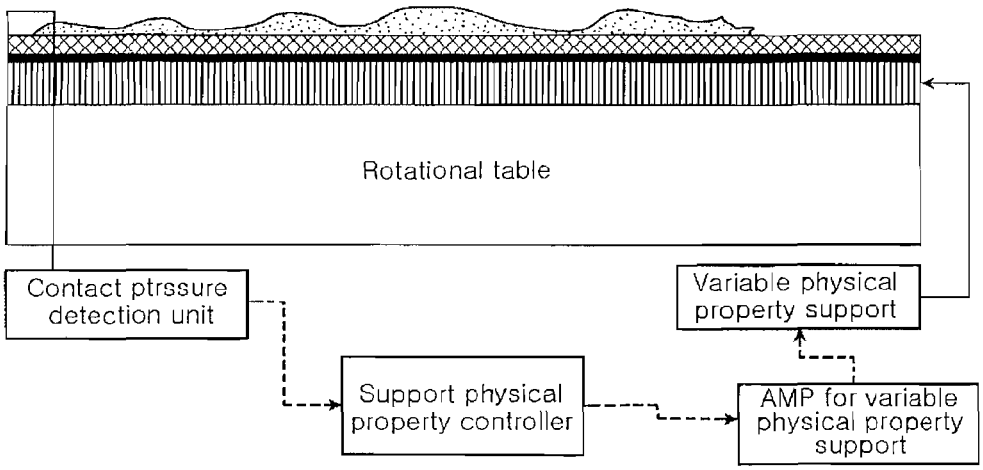
[Fig. 11]
(a)
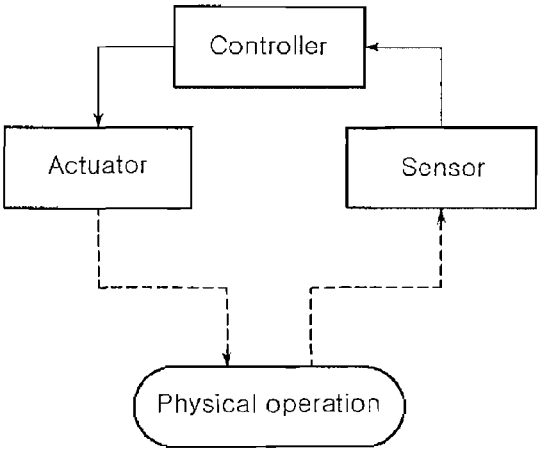
(b)
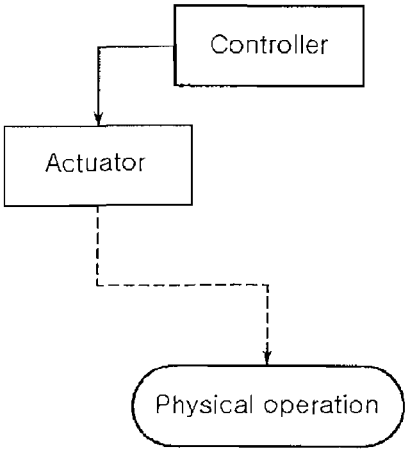

[Fig. 12]
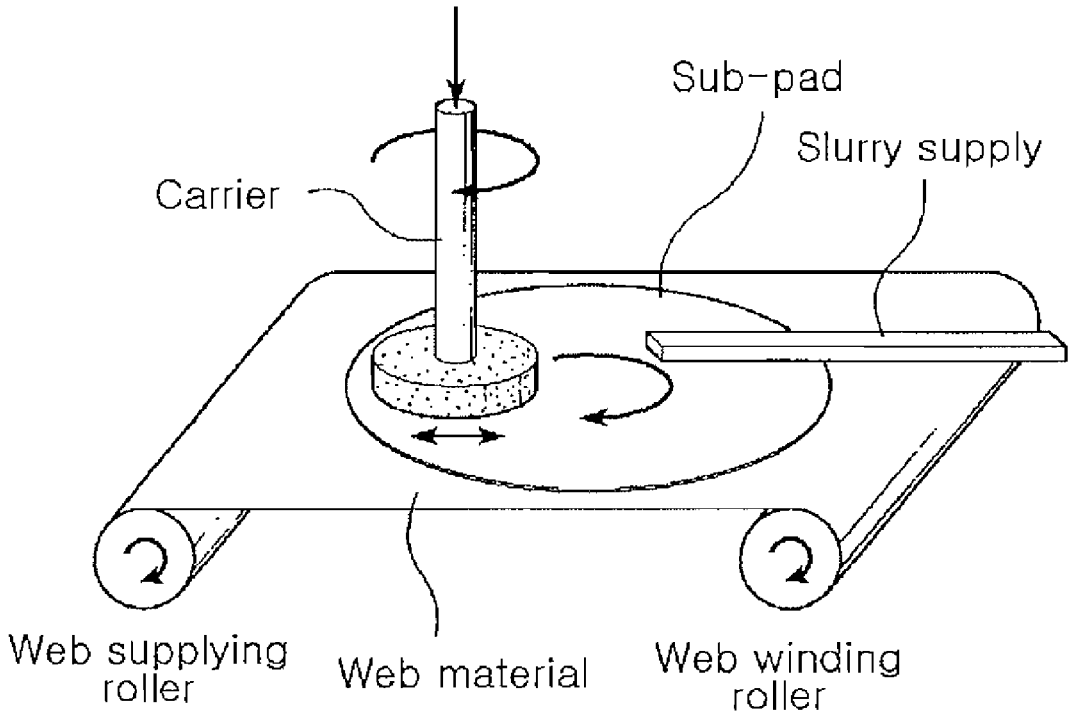
[Fig. 13]
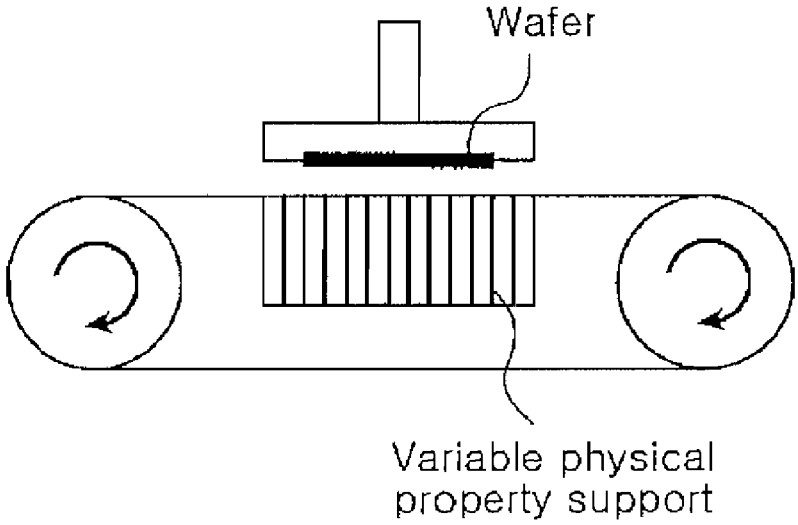

CHEMICAL MECHANICAL POLISHING APPARATUS

TECHNICAL FIELD

The present invention relates to a chemical mechanical polishing apparatus, and, more particularly, to an improved chemical mechanical polishing apparatus which allows active control of contact pressure between a polishing pad and a wafer.

BACKGROUND ART

In recent years, use of a multilayer structure for semiconductor devices has been increasingly growing due to an increase in pattern density of the semiconductor devices. In order to manufacture the semiconductor device of the multilayer structure, it is necessary to perform a process of planarization during manufacture of the semiconductor device. To this end, one of most widely used techniques in the art is a chemical mechanical polishing (CMP) process. In the CMP process, with a polishing pad brought into close contact with a surface of a wafer on which steps are formed, slurries are supplied between the polishing pad and the surface of the wafer to polish the surface of the wafer with polishing abrasives contained in the slurries, thereby obtaining a flattened surface of the wafer. An apparatus for performing the CMP process generally comprises a carrier to hold the wafer, the polishing pad, a rotational table to support the polishing pad, and the like.

FIG. 1 is a constructional view of a conventional chemical mechanical polishing apparatus showing a top surface and a cross-section of the CMP apparatus.

Referring to FIG. 1, the conventional CMP apparatus comprises a carrier 110 to hold a wafer (not shown), a polishing pad 120 to mechanically polish the surface of the wafer via friction with the wafer, and a rotational table 130 to support the polishing pad 120 while rotating for efficient polishing of the wafer. On the polishing pad 120, slurries and other materials are supplied for chemical mechanical polishing of the wafer.

In the CMP apparatus, while the carrier 110 rotates or moves upward or downward, the wafer held by the carrier 100 is brought into contact with the polishing pad 120 and the slurries so that the surface of the wafer is polished. Meanwhile, with the conventional CMP apparatus having the above structure, abrasion is likely to concentrate on a specific region "a" of the polishing pad 120, causing the polishing pad 120 to be compressed at various rates different from locations on the polishing pad 120 where the abrasion occurs at different degrees. As a result, not only the surface of the wafer is non-uniformly polished, but also a replacement cycle of the polishing pad 120 is shortened, thereby increasing the manufacturing costs while deteriorating a quality of the process. In FIG. 2, this phenomenon of the conventional CMP apparatus is shown in detail.

FIG. 2 is a cross-sectional view showing a polishing process using a conventional CMP apparatus.

Referring to FIG. 2, a polishing pad 220 is brought into close contact with a wafer 215 under pressure by a carrier 210 in a condition that the polishing pad 220 is subjected to various compression rates resulting from different degrees of abrasion depending on locations of the polishing pad 220.

In other words, on the polishing pad 220, a compression rate at Part B side which is less abraded than Part C side is higher than the Part C side which is more abraded than the Part B side. In this regard, it is required to provide a technique which can prevent or compliment non-uniform contact pressure between the wafer 215 and the polishing pad 220 due to the different compression rates on the polish pad 220. Reference numeral 230 indicates a rotational table which holds and supports the polishing pad 220.

DISCLOSURE OF INVENTION

Technical Problem

The present invention has been made to solve the above problems, and it is an object of the present invention to provide an improved chemical mechanical polishing apparatus which allows active control of contact pressure between a polishing pad and a wafer.

Additional advantages, objects, and features of the invention will be set forth in part in the description which follows and in part will become apparent to those having ordinary skill in the art upon examination of the following or may be learned from practice of the invention.

Technical Solution

In accordance with a first aspect of the present invention, the above and other objects can be accomplished by the provision of a chemical mechanical polishing apparatus, comprising: a carrier to hold a wafer and being capable of lifting, lowering and rotating; a polishing pad compressed onto the wafer through the lowering of the carrier to polish the wafer; a contact pressure sensor to detect contact pressure between the polishing pad and the wafer when the polishing pad is compressed onto the wafer; a support physical property controller to generate control signals corresponding to the contact pressure detected by the contact pressure sensor; a variable physical property support being adapted to come into close contact with the polishing pad and having physical properties varied in response to the control signals generated by the support physical property controller and a rotational table to hold the variable physical property table.

In accordance with a second aspect of the present invention, a chemical mechanical polishing apparatus is provided, comprising: a carrier to hold a wafer; a polishing pad compressed onto the wafer via three dimensional movements of lifting, lowering and rotating to polish the wafer; a contact pressure sensor to detect contact pressure between the polishing pad and the wafer when the polishing pad is compressed onto the wafer; a support physical property controller to generate control signals corresponding to the contact pressure detected by the contact pressure sensor; a variable physical property support being adapted to come into close contact with the polishing pad and having physical properties varied in response to the control signals generated by the support physical property controller and a rotational table to hold the variable physical property support and being capable of lifting, lowering and rotating.

In accordance with a third aspect of the present invention, a chemical mechanical polishing apparatus is provided, comprising: a carrier to hold a wafer and being capable of lifting, lowering and rotating a polishing pad compressed onto the wafer through the lowering of the carrier to polish the wafer; a support physical property controller to generate control signals to compensate a pressure difference according to a preset process condition a variable physical property support being adapted to come into close contact with the polishing pad and having physical properties varied in response to the control signals generated by the support physical property controller and a rotational table to hold the variable physical property table.

In accordance with a fourth aspect of the present invention, a chemical mechanical polishing apparatus is provided, comprising: a carrier to hold a wafer; a polishing pad compressed onto the wafer via three dimensional movements of lifting, lowering and rotating to polish the wafer; a support physical property controller to generate control signals to compensate a pressure difference according to a preset process condition; a variable physical property support being adapted to come into close contact with the polishing pad and having physical properties varied in response to the control signals generated by the support physical property controller and a rotational table to hold the variable physical property support and being capable of lifting, lowering and rotating.

Preferably, the chemical mechanical polishing apparatus according to the first to fourth aspects of the present invention further comprises an amplifier for the variable physical property support to amplify the control signals generated by the support physical property controller and to transmit the amplified control signals to the variable physical property support.

Preferably, in the chemical mechanical polishing apparatus, the variable physical property support is divided into a plurality of support sectors, each of which is independently controllable.

More preferably, the variable physical property support comprises at least one smart material selected from the group consisting of an electro-rheological fluid, a piezoelectric material and an electroactive polymer, of which physical properties are changed by application of voltage. Alternatively, the variable physical property support may comprise a magneto-rheological fluid, of which viscosity is changed by application of magnetic force, or a magnetostrictive material, of which size is changed by application of the magnetic force. Alternatively, the variable physical property support may comprise a shape memory alloy, of which shape is changed by application of heat.

More preferably, the variable physical property support comprises a plurality of support sectors, each support sector comprising a material having physical properties changed in response to the control signals from the support physical property controller, and an electrode, a magnetic pole or a heating coil to apply voltage, magnetic force or heat in response to the control signals.

Preferably, the chemical mechanical polishing apparatus according to the first to fourth aspects of the present invention further comprises a conditioner to condition a polishing surface of the polishing pad before, during or after polishing. Preferably, the conditioner adjusts an angle between an outer wall and the polishing surface of the polishing pad by conditioning the polishing surface according to a preset process condition. The chemical mechanical polishing apparatus according to the first to fourth aspects of the present invention may further comprise an angle sensor to measure the angle between the outer wall and the polishing surface of the polishing pad, and a conditioning controller to generate control signals corresponding to variation in angle measured by the angle sensor.

Details of other aspects of the present invention will be obvious from the following description and the accompanying drawings.

BRIEF DESCRIPTION OF THE DRAWINGS

FIG. 1 is a constructional view of a conventional chemical mechanical polishing apparatus;

FIG. 2 is a cross-sectional view illustrating a polishing process using a conventional chemical mechanical polishing apparatus;

FIG. 3 is a constructional view of a chemical mechanical polishing apparatus according to one embodiment of the present invention;

FIG. 4 is a constructional view of a chemical mechanical polishing apparatus according to another embodiment of the present invention;

FIGS. 5*a* and 5*b* are cross-sectional views illustrating steps of a polishing process using the chemical mechanical polishing apparatus according to the embodiments of the present invention;

FIG. 6 is a detailed view illustrating a variable physical property support of the chemical mechanical polishing apparatus according to the embodiments of the present invention;

FIGS. 7*a* and 7*b* are exemplary views illustrating arrangements of support sectors of the variable physical property support;

FIG. 8 is a view schematically illustrating one example of a stacked structure of the variable physical property support of the chemical mechanical polishing apparatus according to the embodiments of the present invention;

FIG. 9 is a view schematically illustrating the chemical mechanical polishing apparatus according to the one embodiment of the present invention, which further comprises a conditioner;

FIG. 10 is a diagram schematically illustrating a signal transmission procedure in the case where an amplifier for signal amplification is provided to a support physical property controller of the chemical mechanical polishing apparatus according to the present invention;

FIGS. 11*a* and 11*b* are diagrams schematically illustrating signal transmission procedures in which FIG. 11*a* shows the case where the amplifier for signal amplification is provided to the support physical property controller of the chemical mechanical polishing apparatus according to the present invention, and in which FIG. 11*b* shows the case where the amplifier for signal amplification is not provided thereto;

FIG. 12 is a view schematically illustrating a pad feed polisher in which a polishing pad is adapted to pass between a table and a wafer by a separate roll; and FIG. 13 is a view schematically illustrating a polishing apparatus which comprises the variable physical property support of the present invention under a belt type polishing pad.

BEST MODE FOR CARRYING OUT THE INVENTION

The above and other objects, features and other advantages of the present invention will be more clearly understood from embodiments set forth in the following detailed description in conjunction with the accompanying drawings. It should be noted that the present invention is not limited to the embodiments, and can be embodied in various forms. The embodiments are provided for illustrative purposes, and help those having ordinary knowledge in the art clearly understand the present invention without limiting the scope of the present invention, which is defined only by the accompanying claims.

Embodiments of the present invention will be described hereinafter with reference to the accompanying drawings.

First, a chemical mechanical polishing apparatus according to a first embodiment of the present invention will be described with reference to FIG. 3. FIG. 3 shows the CMP apparatus which performs a polishing process via lifting, lowering and rotating of a wafer 315 with respect to a rotating polishing pad 320.

Referring to FIG. 3, the CMP apparatus according to the first embodiment comprises a carrier 310, the polishing pad 320, a contact pressure sensor 350, a support physical property controller 360, a variable physical property support 340, and a rotational table 330.

As in a typical CMP apparatus, the carrier 310 of the CMP apparatus according to the first embodiment enables the wafer 315 to be lifted, lowered and rotated while holding the wafer 315. As the carrier 310 holding the wafer 315 is lowered, the wafer 315 is compressed onto the polishing pad 320 which serves to polish the wafer 315. Slurries or the like may be supplied between the wafer 315 and the polishing pad 320, and used for chemical mechanical polishing of the wafer 315.

In general, the polishing pad 320 is abraded at various degrees in use due to a difference in tangential velocity between the wafer 315 and the polishing pad 320 according to locations on the polishing pad 320. As a result, the contact pressure between the wafer 315 and the polishing pad 320 become non-uniform.

Hence, the chemical mechanical polishing apparatus of the present invention comprises the variable physical property support 340 formed from a smart material and the like between the polishing pad 320 and the rotational table 330, as a distinguishable feature from the conventional CMP apparatus, such that the physical properties of the smart material constituting the variable physical property support 340 are changed in relation to the contact pressure between the wafer 315 and the polishing pad 320 which is measured by the contact pressure sensor 350, thereby enabling the contact pressure between the wafer 315 and the polishing pad 320 to be kept uniform.

The contact pressure sensor 350 serves to continuously detect the contact pressure upon compression between the wafer 315 and the polishing pad 320, and can transmit the detected contact pressure to the support physical property controller 360 not only before or after polishing, but also during the polishing. The contact pressure sensor 350 is not limited in construction, and may comprise a material, such as a thin plate-shaped piezoelectric film, in order to measure the contact pressure between the wafer 315 and the polishing pad 320. Alternatively, the contact pressure sensor 350 may be any kinds of well-known pressure sensor, which can be used to measure the contact pressure between the wafer 315 and the polishing pad 320.

The support physical property controller 360 serves to generate control signals corresponding to the contact pressure detected by the contact pressure sensor 350. The control signals are transmitted to the variable physical property support 340. Meanwhile, although the control signals can be directly transmitted to the variable physical property support 340 after being generated by the support physical property controller 360, it is preferable that the control signals are transmitted thereto via an amplifier AMP for signal amplification, since the control signals initially have a voltage of 12V, which is generally applied to circuit and cannot be suitable for direct driving of an actuator. The amplifier serves to receive the control signals from the support physical property controller 360 and convert the signals into signals in the form of being applicable to a magnetic pole, an electrode or a heating coil.

Data of the contact pressure can be transmitted from the contact pressure sensor to the support physical property controller via wire or wireless communication. Preferably, the data of the contact pressure is transmitted via the wireless communication for simplification of the CMP apparatus. In addition, although a method for transmitting the control signals from the support physical property controller to the amplifier is not limited, it is preferable that the control signals are transmitted via the wireless communication.

According to the present invention, the variable physical property support 340 is adapted to come into close contact with the polishing pad 320, and changes in physical properties in response to the control signals generated by the support physical property controller 360 so as to enable the polishing pad 320 to exert uniform pressure. Herein, the term "uniform pressure" is not limited to the same pressure in terms of physical meanings, and comprises the meaning of a non-uniform pressure intended to perform a concentrative polishing process on a specific region of the wafer 315.

The variable physical property support 340 may be divided into a plurality of support sectors, each of which can be independently controlled by the support physical property controller 360. FIGS. 5*a* and 5*b* show a variable physical property support 520 or 525 which is divided into the plurality of support sectors, and the shape of the variable physical property support 520 or 525 when control signals are differently applied to the respective support sectors. As can be seen from the drawings, since the support sectors at or near the central region of the variable physical property support 520 or 525 are subjected to a small contact pressure relative to various contact pressures between a polishing pad 540 or 545 and a wafer 550 or 555 detected by a contact pressure sensor 530 or 535, these support sectors extend more than other support sectors apart from the central region of the variable physical property support 520 or 525. Thus, a contact surface between the wafer 550 or 555 and the polishing pad 540 or 545 can be uniformly controlled. Reference numerals 510 and 515 indicate a rotational table.

FIG. 6 shows details of a variable physical property support 610 of the present invention, and FIGS. 7*a* and 7*b* schematically show exemplary configurations of the variable physical property support 610 for the chemical mechanical polishing apparatus of the present invention, in which the variable physical property support 610 can be divided into a plurality of support sectors "d." It should be noted that a dividing pattern of the support sectors "d" is not limited to the arrangements shown in the drawings, and can be modified into various arrangements.

As shown in FIG. 6, the variable physical property support 610 for the CMP apparatus of the present invention is divided into the plurality of support sectors "d,"each of which comprises smart material sections 650 and a buffering member 630 between the smart material sections 650 to act as a buffer to support shape restoration of the smart material sections 650. In addition, the variable physical property support 610 comprises a signal application part 640 and other components, which can apply activating signals to the smart material sections 650. The signals from the signal application part 640 are converted via the support physical property controller 360 or 460 based on the contact pressure of the polishing pad detected by a contact pressure sensor 620, and is then transmitted to the variable physical property support 610.

According to the present invention, the variable physical property support 610 preferably comprises smart materials, of which physical properties, viscosity, size or shape can be changed by application of voltage, magnetic force or heat. Principles and applications of the smart materials applicable to the present invention are disclosed in Smart Structures and Materials (Artech House Optoelectronics Library, Brian Culshaw, January, 1996), Electro-Rheological Fluids and Magneto-Rheological Suspensions (Ronjia Tao, Jan. 15, 2000), Electroactive Polymer (EAP) Actuators as Artificial Muscles; Reality, Potential, and Challenges, Second Edition (SPIE Press Monograph Vol. PM 136, Yoseph Bar-Cohen, Mar. 18, 2004), Electro Ceramics; Materials, Properties, Applications (A. J. Moulson/J. M. Herbert, Jul. 7, 2003).

The configuration and operation of peripheral components can be changed according to the smart materials applied to the present invention.

As the smart materials for the variable physical property support 610 of the invention, there are electro-rheological fluids, piezoelectric materials and electroactive polymers, of which physical properties are changed by application of voltage.

At this point, the variable physical property support 610 may comprise: the plurality of support sectors "d", of which physical properties are changed in response to the control signals from the support physical property controller 360; electrodes as the signal application part 640 to apply the voltage to the support sectors "d" in response to the control signals; and the buffering member 630 to support the shape restoration of the support sectors "d."

More preferably, if the smart material sections 650 are formed from the piezoelectric material, each of the support sectors "d" may have a stacked structure. FIG. 8 schematically shows one example of the variable physical property support, which comprises smart material sections formed from the piezoelectric material, and a plurality of support sectors, each of which has the stacked structure. It is desirable that the piezoelectric material be stacked in multiple layers as shown in FIG. 8, since the stacked structure of FIG. 8 can enlarge variation in shape with respect to the same control signals. Here, the layers are preferably stacked alternately to have opposite poling directions with an electrode material interposed between the layers.

An application direction of the voltage and the polarity to the electrodes is controlled by the support physical property controller rather than being fixed. For example, when applying +/− voltage to the electrodes, the length of the variable physical property support decreases, but when applying −/+ voltage to the electrodes, the length of the variable physical property support decreases. In this case, a degree of increase or decrease in the length is proportional to the pressure. As in the preferred example of the present invention described above, when the variable physical property support has the stacked structure of the piezoelectric material in which the layers are alternately stacked to have the opposite poling directions, the shape variation of the variable physical property support can increase even with application of the same voltage.

In addition, the buffering member 630 may be a chamber which can restore the shapes of the support sectors "d" by use of hydraulic pressure or air pressure. If a hydraulic chamber or an air pressure chamber is employed as the buffering member 630, the CMP apparatus of the present invention further comprises an air pressure regulator (not shown) or a hydraulic pressure pump (not shown) to apply the pressure to the chamber, and a controller (not shown) to control the hydraulic chamber or the air pressure chamber by transmitting a control signal to the air pressure regulator or the hydraulic pressure pump. The buffering member may comprise low density polymer materials. As the low density polymer materials, there are polyurethane foam, polyethylene foam, PVC foam, rubber foam, etc.

As a material for the smart material sections 650 of the variable physical property support 610, there is a magneto-rheological fluid, of which viscosity is changed by application of magnetic force, or a magnetostrictive material, of which size is changed by application of the magnetic force. At this point, the variable physical property support may comprise: the plurality of support sectors "d", of which viscosity or size changes in response to the control signals from the support physical property controller 360 magnetic poles as the signal application part 640 to apply the magnetic force to the support sectors "d" in response to the control signals from the support physical property controller 360 a hydraulic or air pressure chamber to divide the plurality of support sectors "d" from each other and to support shape restoration of the electro-rheological fluid and the magnetostrictive material an air pressure regulator (not shown) or a hydraulic pressure pump (not shown) to apply pressure to the chamber and a controller to control the chamber.

Furthermore, as a material for the smart material sections 650 of the variable physical property support 610, there is a shape memory alloy, of which shape is changed by application of heat. At this point, the variable physical property support 610 may comprise: the plurality of support sectors "d", of which shape changes in response to the control signals from the support physical property controller 360 a heating coil as the signal application part 640 to apply the heat to the support sectors "d" in response to the control signals from the support physical property controller 360 and a buffering member 630 to divide the plural support sectors "d" from each other and to support shape restoration of the shape memory alloy.

The buffering member may comprise low density polymer materials. As the low density polymer materials, there are polyurethane foam, polyethylene foam, PVC foam, rubber foam, etc.

FIG. 4 is a constructional view of a chemical mechanical polishing apparatus according to a second embodiment of the present invention. The CMP apparatus according to the second embodiment will be described hereinafter with reference to FIG. 4. In description of the second embodiment, the same components and operations as those of the first embodiment will be omitted herein.

FIG. 4 shows the CMP apparatus of the second embodiment which performs a polishing process via lifting, lowering or rotating of a polishing pad 420 with respect to a wafer 415.

Referring to FIG. 4, the CMP apparatus according to the second embodiment comprises a carrier 410, the polishing pad 420, a contact pressure sensor 450, a support physical property controller 460, a variable physical property support 440, and a rotational table 430.

In the CMP apparatus according to the second embodiment, the wafer 415 is held by carrier 410 to rotate without deviating from its original position, and the polishing pad 420 is compressed onto the wafer 415 to perform the polishing process while being lifted, lowered or rotated by the rotational table 430. The polishing process is performed on the surface of the wafer under pressure generated between the wafer 415 and the polishing pad 420 when the polishing pad 420 having a smaller size than that of the wafer 415 is lifted, lowered, or rotated along with the rotational table 430 which supports the polishing pad 420.

In the CMP apparatus according to the second embodiment, as shown in FIG. 4, the variable physical property support 440 is positioned between the polishing pad 420 and the rotational table 430 which enables the lifting, lowering and rotating operation of the polishing pad 420. In addition, the contact pressure sensor 450 is positioned between the polishing pad 420 and the variable physical property support 440 to detect contact pressure between the polishing pad 420 and the wafer 415. The other construction and operation of the second embodiment is the same as that of the first embodiment, and thus detailed description thereof will be omitted herein.

There will be described CMP apparatuses according to third and fourth embodiments of the present invention hereinafter. The CMP apparatuses of the third and fourth embodiments have the same construction as that of the CMP apparatuses of the first and second embodiments, except that the CMP apparatuses of the third and fourth embodiments do not comprise the contact pressure sensor 350 or 450.

Both CMP apparatuses of the third and fourth embodiments employ an open loop control (OLC) manner, by which data obtained from process conditions, such as a using time and an RPM of the polishing pad 320 or 420, pressure of the carrier 310 or 410, a polishing rate, etc., is previously input into the support physical property controller 360 or 460, to generate control signals, instead of employing a closed loop control (CLC) manner, by which the support physical property controller 360 or 460 generates the control signals based on information from the sensor. With this structure, both CMP apparatuses of the third and fourth embodiments have advantages, such as reduced manufacturing costs and simplified structure.

FIG. 10 schematically shows generation and transmission of control signals of a polishing apparatus according to the third or fourth embodiments, which comprises the contact pressure sensor (contact pressure detection unit). Referring to FIG. 10, after detecting contact pressure on the polishing pad, the contact pressure sensor transmits the detected contact pressure to the support physical property controller, and then, the support physical property controller generates and transmits control signals to the variable physical property support, thereby driving the variable physical property support to compliment the contact pressure of the polishing pad. At this point, the control signals generated by the support physical property controller may be amplified by an amplifier of the variable physical property support, and transmitted to the variable physical property support.

FIGS. 11*a* and 11*b* show a difference in signal transmission procedures between the CMP apparatus of the first or second embodiments and the CMP apparatus of the third or fourth embodiments. Specifically, FIG. 11*a* shows a control signal transmission procedure in the CMP apparatus of the first or second embodiment which comprises the contact pressure sensor 350 or 450. In the CMP apparatus of the first or second embodiment, the contact pressure sensor 350 or 450 detects the contact pressure on the polishing pad 320 or 420, and the support physical property controller (controller) 360 or 360 generates and transmits the control signals corresponding to the detected contact pressure to the variable physical property support (actuator) 340 or 440, thereby allowing the variable physical property support (actuator) 340 or 440 to make the contact pressure uniform corresponding to the control signals. On the other hand, FIG. 11*b* shows a control signal transmission procedure in the CMP apparatus of the third or fourth embodiment which does not comprise the contact pressure sensor 350 or 450. Unlike the CMP apparatuses of the first and second embodiments shown in FIG. 11*a*, in the CMP apparatus of the third or fourth embodiment, the control signals are transmitted to the controller according to a preset process condition without detecting the contact pressure by the sensor.

According to the present invention, the CMP apparatus may further comprise a conditioner to condition a polishing surface of the polishing pad before, during or after the polishing operation. The conditioner removes deposits caused by the polishing process, thereby maintaining the surface roughness of the polishing pad 320 or 420 at a constant degree while enhancing the polishing rate of the apparatus. In FIG. 9, the CMP polishing apparatus comprising the conditioner is schematically shown.

According to the present invention, the conditioner has a function to adjust an angle between an outer wall and the polishing surface of the polishing pad 320 or 420 as well as the typical function to condition the polishing surface of the polishing pad as described above. Generally, an abrasion ratio is higher at an outer periphery than the center of the polishing pad 320 or 420 due to a difference in centrifugal force of the polishing pad, causing a change in the angle between the outer wall and the polishing surface of the polishing pad 320 or 420. Since the polishing operation cannot be performed uniformly in this case, it is preferable that the angle between the outer wall and the polishing surface be maintained the same as that before the polishing operation through the conditioning operation of the conditioner.

In order to perform the conditioning operation, the conditioner may comprise an angle sensor to measure the angle between the outer wall and the polishing surface of the polishing pad 320 or 420, and a conditioning controller to generate control signals corresponding to variation of the angle measured by the angle sensor.

Alternatively, the angle between the outer wall and the polishing surface of the polishing pad 320 or 420 can be adjusted in such a way that a preset process condition is previously inputted into the conditioning controller to condition the polishing surface, instead of detecting the angle by use of the angle sensor.

The chemical mechanical polishing apparatuses according to the above embodiments may be applied to a pad feed polisher (see FIG. 12) which comprises a polishing pad supplied by a separate roll to pass between a table and a wafer instead of being secured to other components, or to a sequential linear polisher which comprises a polishing pad configured to continuously rotate by a belt, and an air pressure nozzle attached to a lower surface of the belt to compress a wafer. In this case, the variable physical property support may be disposed under the belt as shown in FIG. 13.

In the chemical physical polishing apparatus according to the embodiments of the present invention, the smart material constituting the respective support sectors independently changes in physical properties in response to separate control signals applied to the respective support sectors, so that the polishing pad and the wafer on the overall surface of the variable physical property support come into close contact with each other while maintaining a uniform contact pressure therebetween.

In the embodiments described above, although the respective support sectors are described as being controlled independently, the control operation can be performed with respect to respective groups of support sectors, which comprises a predetermined number of support sectors.

It should be understood that the embodiments and the accompanying drawings have been described for illustrative purposes, and the present invention is limited only by the following claims. Further, those skilled in the art will appreciate that various modifications, additions and substitutions are allowed without departing from the scope and spirit of the invention according to the accompanying claims.

Industrial Applicability

As apparent from the above description, the CMP apparatus according to the present invention is configured to control contact pressure between a wafer and a polishing pad to become uniform or non-uniform according to process conditions. With this structure, the CMP apparatus of the present invention is able to perform a more flexible polishing operation on the wafer corresponding to the characteristics of a process, thereby reducing process costs caused by compensation for an abraded amount of the polishing pad.

The invention claimed is:

1. A chemical mechanical polishing apparatus, comprising:

a carrier to hold a wafer and being capable of lifting, lowering and rotating;

a polishing pad compressed onto the wafer through the lowering of the carrier to polish the wafer;

a support physical property controller to generate control signals;

a variable physical property support adapted to come into close contact with the polishing pad and having physical properties varied in response to the control signals generated by the support physical property controller;

a rotational table to hold the variable physical property support; and a conditioner to condition a polishing surface of the polishing pad before, during or after a polishing operation, wherein the conditioner adjusts an angle between an outer wall and the polishing surface of the polishing pad by conditioning the polishing surface of the polishing pad according to a preset process condition.

2. The chemical mechanical polishing apparatus according to claim 1, further comprising a contact pressure sensor to detect contact pressure between the polishing pad and the wafer when the polishing pad is compressed onto the wafer.

3. The chemical mechanical polishing apparatus according to claim 2, wherein the control signals is generated to correspond to the contact pressure detected by the contact pressure sensor.

4. The chemical mechanical polishing apparatus according to claim 2, wherein the contact pressure sensor transmits data of the contact pressure to the support physical property controller via wireless communication.

5. The chemical mechanical polishing apparatus according to claim 1, wherein the control signals are generated to compensate for a pressure difference according to a preset process condition.

6. The chemical mechanical polishing apparatus according to claim 1, further comprising:

an amplifier for the variable physical property support to amplify the control signals generated by the support physical property controller and then transmit the amplified control signals to the variable physical property support.

7. The chemical mechanical polishing apparatus according to claim 6, wherein the support physical property controller transmits the control signals to the amplifier for the variable physical property support via wireless communication.

8. The chemical mechanical polishing apparatus according to claim 1, wherein the variable physical property support is divided into a plurality of support sectors.

9. The chemical mechanical polishing apparatus according to claim 8, wherein each of the support sectors is independently controllable by the support physical property controller.

10. The chemical mechanical polishing apparatus according to claim 8, wherein the variable physical property support varies in physical properties, viscosity, size, or shape by an application of voltage, magnetic force or heat.

11. The chemical mechanical polishing apparatus according to claim 10, wherein the variable physical property support comprises at least one material selected from the group consisting of an electro-rheological fluid, a piezoelectric material, and an electro-active polymer.

12. The chemical mechanical polishing apparatus according to claim 11, wherein the variable physical property support comprises:

the plurality of support sectors each having its physical properties changed in response to the control signals applied from the support physical property controller;

electrodes to apply the voltage to the support sectors in response to the control signals; and a buffering member to divide the plurality of support sectors from each other and to support shape restoration of the support sectors.

13. The chemical mechanical polishing apparatus according to claim 11, wherein the variable physical property support comprises the piezoelectric material and each of the support sectors has a stacked structure.

14. The chemical mechanical polishing apparatus according to claim 13, wherein the buffering member is a chamber to restore the shape of each support sector via hydraulic or air pressure.

15. The chemical mechanical polishing apparatus according to claim 14, further comprising:

an air pressure regulator or a hydraulic pressure pump to apply pressure to the chamber; and a controller to control the hydraulic chamber or the air pressure chamber.

16. The chemical mechanical polishing apparatus according to claim 12, wherein the buffering member comprises a low density polymer material.

17. The chemical mechanical polishing apparatus according to claim 16, wherein the low density polymer material is at least one selected from the group consisting of polyurethane foam, polyethylene foam, PVC foam, and rubber foam.

18. The chemical mechanical polishing apparatus according to claim 10, wherein the variable physical property support comprises a magneto-rheological fluid, of which viscosity is changed by application of magnetic force, or a magneto-astrictive material, of which size is changed by application of the magnetic force.

19. The chemical mechanical polishing apparatus according to claim 18, wherein variable physical property support comprises:

the plurality of support sectors, of which viscosity or size is changed in response to the control signals from the support physical property controller;

magnetic poles to apply the magnetic force to the support sectors in response to the control signals from the support physical property controller;

a hydraulic or air pressure chamber to divide the plurality of support sectors from each other and to support shape restoration of the magneto-rheological fluid or the magneto-strictive material;

an air pressure regulator or a hydraulic pressure pump to apply pressure to the chamber; and a controller to control the chamber.

20. The chemical mechanical polishing apparatus according to claim 8, wherein the variable physical property support comprises a shape memory alloy having the shape changed by application of the heat.

21. The chemical mechanical polishing apparatus according to claim 20, wherein variable physical property support comprises:

the plurality of support sectors, of which shape is changed in response to the control signals from the support physical property controller;

a heating coil to apply the heat to the support sectors in response to the control signals from the support physical property controller; and a buffering member to divide the plurality of support sectors from each other and to support shape restoration of the shape memory alloy.

22. The chemical mechanical polishing apparatus according to claim 21, wherein the buffering member comprises a low density polymer material.

23. The chemical mechanical polishing apparatus according to claim 21, wherein the low density polymer material is at least one selected from the group consisting of polyurethane foam, polyethylene foam, PVC foam, and rubber foam.

24. The chemical mechanical polishing apparatus according to claim 1, further comprising:

an angle sensor to measure the angle between the outer wall and the polishing surface of the polishing pad; and a conditioning controller to generate control signals corresponding to variation in angle measured by the angle sensor.

25. The chemical mechanical polishing apparatus according to claim 24, further comprising:

a conditioning amplifier to amplify the control signals generated by the conditioning controller.

* * * * *